US011725552B2

(12) United States Patent
Wall et al.

(10) Patent No.: US 11,725,552 B2
(45) Date of Patent: Aug. 15, 2023

(54) INTERNAL COMBUSTION ENGINE AND METHOD OF OPERATING SAME

(71) Applicant: INNIO Jenbacher GmbH & Co OG, Jenbach (AT)

(72) Inventors: Gunther Wall, Bad Haring (AT); Jakub Holecek, Innsbruck (AT); Susanne Chvatal, Jenbach (AT)

(73) Assignee: Innio Jenbacher GmbH & Co OG, Jenbach (AT)

( * ) Notice: Subject to any disclaimer, the term of this patent is extended or adjusted under 35 U.S.C. 154(b) by 0 days.

(21) Appl. No.: 17/617,297

(22) PCT Filed: Jun. 7, 2019

(86) PCT No.: PCT/AT2019/060189
§ 371 (c)(1),
(2) Date: Dec. 7, 2021

(87) PCT Pub. No.: WO2020/243758
PCT Pub. Date: Dec. 10, 2020

(65) Prior Publication Data

US 2022/0307397 A1 Sep. 29, 2022

(51) Int. Cl.
*F01M 11/04* (2006.01)
*F01M 11/00* (2006.01)
(Continued)

(52) U.S. Cl.
CPC ..... *F01M 11/0458* (2013.01); *F01M 11/0004* (2013.01); *F01M 2011/021* (2013.01); *F01M 2013/0438* (2013.01)

(58) Field of Classification Search
CPC ..... F01M 11/0458; F01M 11/0004; F01M 2011/021; F01M 2013/0438
See application file for complete search history.

(56) References Cited

U.S. PATENT DOCUMENTS 10,760,459 B2 * 9/2020 Foerster ..... F01M 11/0458
2008/0277201 A1 * 11/2008 Taguchi ..... F02B 37/007 184/6.5
2017/0002704 A1 * 1/2017 Takada ..... F01M 13/04

FOREIGN PATENT DOCUMENTS

DE 102015014950 A1 * 5/2017
DE 102015014950 A1 5/2017
(Continued)

OTHER PUBLICATIONS

PCT International Search Report and Written Opinion of Application No. PCT/AT2019/060189 dated Feb. 26, 2020; 6 pages.

*Primary Examiner* — Syed O Hasan
(74) *Attorney, Agent, or Firm* — Fletcher Yoder, P.C.

(57) ABSTRACT

An internal combustion engine having an oil circuit, wherein the oil circuit is designed to supply at least one component of the internal combustion engine with lubricating oil, and at least one oil reservoir for providing the lubricating oil for the oil circuit, wherein there is provided at least one collecting container separate from the at least one oil reservoir, wherein lubricating oil in the oil circuit downstream of the at least one component can be collected in the at least one collecting container, and there is provided at least one removal device, by means of which at least a part of the lubricating oil collected in the at least one collecting container is removable from the at least one oil circuit.

21 Claims, 1 Drawing Sheet

(51) Int. Cl.
*F01M 11/02* (2006.01)
*F01M 13/04* (2006.01)

(56) References Cited

FOREIGN PATENT DOCUMENTS

| | | | | |
|---|---|---|---|---|
| EP | 0684368 | A1 | | 11/1995 |
| EP | 0928883 | | * | 7/1999 |
| EP | 0928883 | A1 | | 7/1999 |
| JP | 0684368 | | * | 5/1994 |

* cited by examiner

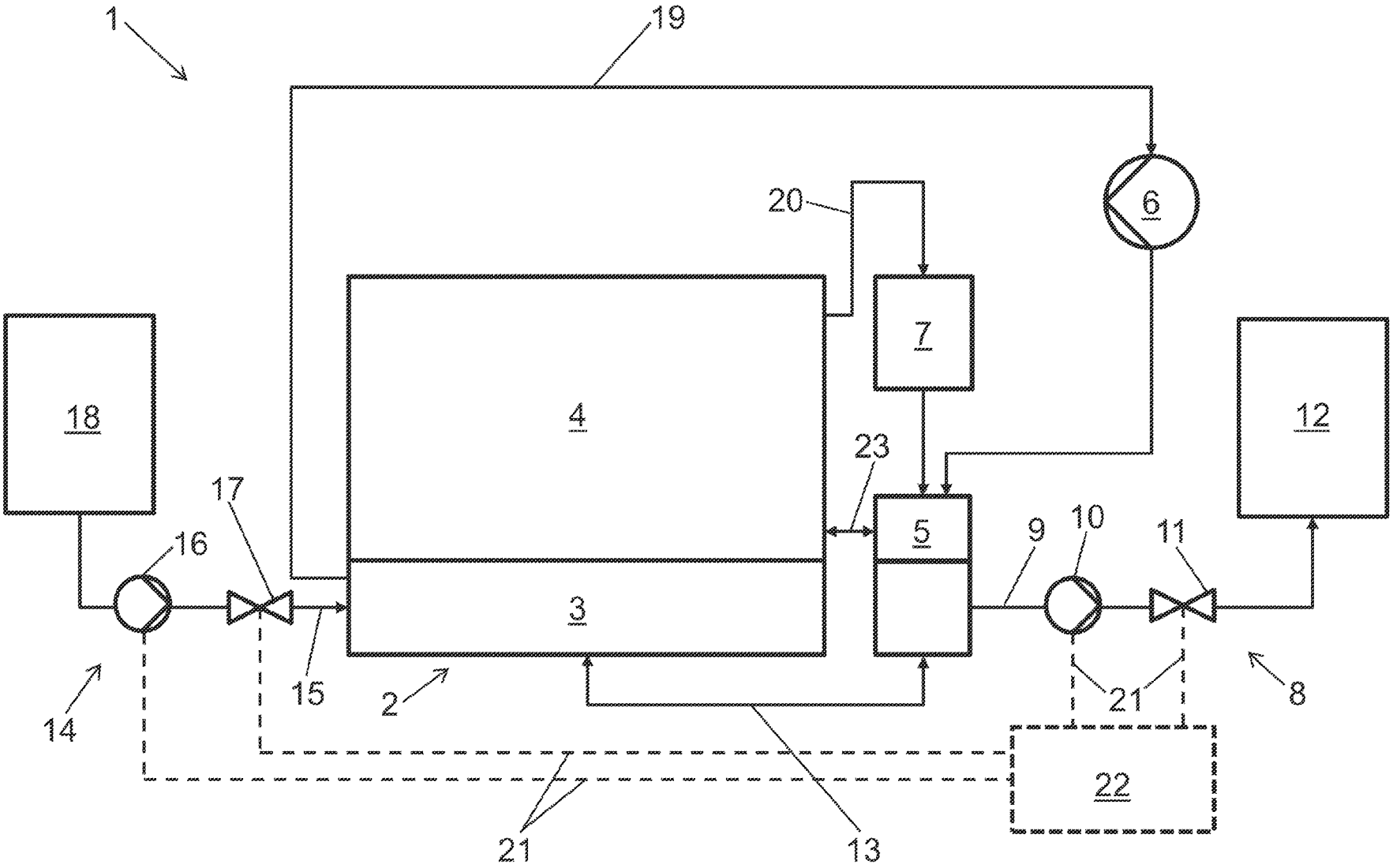
1
2
3
4
5
6
7
8
9
10
11
12
13
14
15
16
17
18
19
20
21
22
23

INTERNAL COMBUSTION ENGINE AND METHOD OF OPERATING SAME

CROSS-REFERENCE TO RELATED APPLICATION

This application is a National Stage entry from, and claims benefit of, PCT Application No. PCT/AT2019/060189, filed on Jun. 7, 2019; entitled "INTERNAL COMBUSTION ENGINE AND METHOD OF OPERATING SAME."

BACKGROUND

The present invention concerns an internal combustion engine comprising an oil circuit having the features of the classifying portion discussed below, and a method of operating an internal combustion engine having the features of the classifying portion discussed below.

To be able to guarantee proper operation and a long service life of an internal combustion engine, a necessary requirement is to provide a certain quality and amount of lubricating oil. In general, an amount of lubricating oil can vary because of operation of the internal combustion engine by virtue of a certain consumption of the lubricant, which naturally occurs in the combustion cylinders and other positions at elevated temperature. Therefore, the amount of lubricating oil has to be periodically checked (generally by the operator or automatically by way of the engine management) and—if required—a suitable amount of fresh lubricant has to be added to the internal combustion engine to maintain the required amount of lubricant in the internal combustion engine.

In general, the quality of the lubricating oil in an internal combustion engine also decreases with operation of the engine. Lubricating oil degradation occurs by virtue of a fall in efficacy of lubricant additives, which perform specific functions like viscosity control, wear, increase in lubrication capability, minimization of deposits, prevention of oxidation, and other desired properties. Lubricating oil degradation can also occur by virtue of foreign bodies getting into the lubricating oil, such as dirt from the environment, wear materials from the engine occurring as part of the natural operating procedure, and combustion residues from the combustion process.

Factors which influence the lubricating oil quality are intensive and/or long contact with combustion gases, intensive and/or long contact with hot and/or large surfaces, high temperatures or contact with catalytically operative substances (for example, metals such as copper or iron) in the internal combustion engine.

The lubricating oil has to be replaced when reaching a given lower quality limit or after a given number of operating hours. Particularly, in the case of stationary internal combustion engines, however, replacing the entire engine oil and the associated filters represents a major task. Substantial effort and costs are also linked to disposing of the considerable amount of lubricating oil and re-filling the internal combustion engine. It is important, therefore, to find a way of maintaining the lubricating oil quality as long as possible in order to have to carry out an oil change (and the service tasks linked thereto) as seldom as possible and to reduce the operating costs of the machine.

One way of improving the quality of the lubricating oil of the internal combustion engine involves periodically removing a part or all of the lubricating oil and replacing it with fresh lubricating oil. Filters are also used to remove foreign materials above a given particle size from the lubricating oil.

In that respect, for example, methods are known in which during operation of the internal combustion engine small amounts of lubricating oil are continuously or in time-displaced relationship removed from the sump of the internal combustion engine and those amounts are replaced at the same time by fresh lubricating oil. That is described, for example, by EP 0 928 883 B1.

A disadvantage with such a method, however, is that, upon removal of lubricating oil from the sump, lubricating oil which is not yet at the limits of usability or endurance in terms of its quality is also removed. As the lubricating oil in the sump repeatedly mixes with the fresh and the stale oil, a lubricating oil mixture is always formed in the sump, which would not yet necessarily have to be removed from the oil circuit of the internal combustion engine by reasons of inadequate quality.

BRIEF DESCRIPTION

The object of the invention is to provide an internal combustion engine and a method of operating an internal combustion engine, by means of which the lubricating oil quality in an oil circuit can be improved and/or the operating hours of the internal combustion engine can be extended during two oil change intervals. In particular, the stated disadvantages with methods known from the state of the art are to be eliminated.

That object is attained by an internal combustion engine having the features described below and a method of operating an internal combustion engine having the features described below.

That is achieved in that the oil circuit is designed by guiding lubricating oil to supply at least one component of the internal combustion engine, comprising at least one oil reservoir for providing the lubricating oil for the oil circuit, wherein the at least one component includes at least one turbocharger and/or a blow-by filter, wherein

- there is provided at least one collecting container separate from the at least one oil reservoir, wherein lubricating oil in the oil circuit downstream of the at least one component can be collected in the at least one collecting container, and
- there is provided at least one removal device, by means of which at least a part of the lubricating oil collected in the at least one collecting container is removable from the at least one oil circuit.

By virtue of the provision of a collecting container which catches lubricating oil coming from a component, in respect of which the lubricating oil is used for cooling or for lubrication, a lubricating oil which is the most heavily polluted can be collected before it mixes again with lubricating oil which is not so heavily polluted, for example, in an oil pan of the internal combustion engine. By virtue of the fact that the lubricating oil which is most heavily polluted is at least partially removed from the at least one collecting container, a separated lubricating oil which is most heavily polluted can be specifically removed from the oil circuit and thus specifically (e.g., only) the most heavily polluted lubricating oil of the lowest quality is drained off.

Advantageous embodiments of the invention are recited in the appendant claims.

Preferably, there is provided at least one return line, by means of which at least a part of the lubricating oil collected in the at least one collecting chamber can be returned into the at least one oil reservoir, preferably by way of a filter element.

Consequently for example, this affords the option that only a part of the polluted lubricating oil is removed from the collecting container, and the remaining part of the polluted oil is returned to the oil reservoir again for further use in the oil circuit. A small amount of polluted lubricating oil can be continuously discharged by virtue of such a design configuration. If the entire amount of lubricating oil were to be drained from the collecting container, that would result in an undesirably greatly increased lubricating oil consumption on the part of the internal combustion engine.

It can be provided that the at least one oil reservoir is at least partially in the form of an oil pan or oil sump of the internal combustion engine. It is, however, also certainly conceivable that the oil reservoir is in the form of a separate lubricating oil tank or in the form of a separate lubricating oil tank in addition to an oil pan or an oil sump of the internal combustion engine.

It is preferably provided that the at least one component includes at least one turbocharger. It is common in the state of the art for a turbocharger of the internal combustion engine to be lubricated and/or cooled by the lubricating oil and the oil circuit. However, the lubricating oil upon cooling and/or lubrication of the turbocharger is exposed to a severe thermal loading as the turbocharger is at elevated temperatures and the lubricating oil is aged (e.g., oxidized) to an increased degree in the turbocharger by contact with exhaust gases and is contaminated by combustion particles.

It can be provided that the at least one component includes a blow-by filter.

It is known that so-called blow-by gases are generated in operation of an internal combustion engine, and they have to be purged from a crankcase of the internal combustion engine to avoid a rise in the pressure in the crankcase. In closed crankcase-breather systems that crankcase-breather gas (e.g., blow-by gas) is fed back to an air intake of the internal combustion engine. The carrier gas contains fine droplets and solid particles of the order of magnitude of about 0.1 μm to 10 μm.

In order to avoid adverse effects of that oil contained in the blow-by gas on components in the air intake of the internal combustion engine, it is known for oil and also solid particles to be separated from the carrier gas by means of a blow-by filter.

It can be provided that a volume of the lubricating oil in the at least one collecting container is between 5% and 10% of the total volume of oil in the oil circuit. The total oil volume in the oil circuit can in that case be calculated from the volume of the lubricating oil in the conduits in the internal combustion engine, from the volume of the lubricating oil in the oil reservoir or oil pan (which is possibly provided), from the volume of the lubricating oil in the external oil tank (which is possibly provided), and from the oil volume of the lubricating oil in filter units (which are preferably provided).

It is preferably provided that the at least one removal device has at least one removal line, at least one pump, at least one open-loop or closed-loop controllable valve and/or at least one old oil tank.

Particularly (e.g., preferably), there is provided at least one feed device, wherein by means of said at least one feed device additional fresh lubricating oil can be fed to the oil circuit, preferably by way of the at least one oil reservoir.

The synonym "fresh lubricant" used in this application is to be interpreted as a base lubricant/lubricating oil which contains a desired amount and kind of fresh lubricant additives and/or is free of foreign substances to a certain degree.

It can be provided that the at least one feed device has at least one feed line, at least one pump, at least one open-loop or closed-loop controllable valve and/or at least one fresh oil tank.

In an embodiment of the invention, there is provided an open-loop or closed-loop control unit, which is connected in signal-conducting relationship to the at least one feed device, and which is adapted to feed a defined volume of oil to the oil circuit by open-loop or closed-loop control of the at least one feed device. Preferably, in that respect, it can be provided that the at least one feed device is adapted to maintain constant a total oil volume in the oil circuit by open-loop or closed-loop control of the at least one feed device.

Accordingly, there can be provided an open-loop or closed-loop control unit and a feed device, by means of which an oil volume is automatically maintained constant in the oil circuit.

Preferably, there is provided an open-loop or closed-loop control unit, which is connected in signal-conducting relationship to the at least one removal device, and which is adapted to remove a defined volume of oil from the collecting container by open-loop or closed-loop control of the at least one removal device. In that respect, it can preferably be provided that, at predetermined time intervals, the open-loop or closed-loop control unit takes a predetermined volume of lubricating oil from the collecting container and, preferably by a feed line, feeds the removed volume of oil to the oil circuit again in the form of fresh oil.

It is preferably provided that the at least one collecting container and at least one crankcase are connected together above a liquid level, so that gases can circulate between the at least one collecting container and the crankcase.

Protection is also claimed for a method of operating an internal combustion engine, wherein at least one component of the internal combustion engine is lubricated and/or cooled by means of a lubricating oil guided in an oil circuit, and wherein lubricating oil is provided for the oil circuit by at least one oil reservoir, characterised in that

- lubricating oil in the oil circuit downstream of the at least one component is collected in a collecting container separate from the at least one oil reservoir, and
- at least a part of the lubricating oil collected in the at least one collecting container is removed by a removal device.

In the context of the invention, the term "collected downstream" can be used to mean that an oil of higher quality, applied to at least one component of the internal combustion engine, possibly suffers a loss in quality due to lubrication and/or cooling of that at least one component, and the oil which comes—preferably directly—from the at least one component and which is possibly of reduced quality is then collected (that is to say, under some circumstances, independently of the formation of a liquid flow).

It is preferably provided that the possibly reduced-quality oil is caught by at least one blow-by filter downstream of at least one component, and is collected in the at least one collecting container.

BRIEF DESCRIPTION OF THE DRAWINGS

Further advantages and details of the invention will be apparent from the FIGURE and the accompanying specific description.

FIG. 1 shows an embodiment of an internal combustion engine having an oil circuit.

DETAILED DESCRIPTION

FIG. 1 shows an embodiment of an internal combustion engine 1 according to the invention having an oil circuit. In that arrangement, the internal combustion engine 1 has a crankcase 4, which is closed in its lower region by an oil pan 3. In this embodiment, the oil pan 3 forms the oil reservoir 2.

Lubricating oil can be fed to individual components of the internal combustion engine 1 by the oil circuit. Thus, for example, lubricating oil from the oil pan 3 is fed by way of the supply line 19 to the turbocharger 6 to cool or lubricate it. In addition, a blow-by gas can be discharged from the crankcase 4 by a discharge line 20 for blow-by gases and can be fed to a blow-by filter 7.

Subsequently to the components (e.g., turbocharger 6 and blow-by filter 7), the lubricating oil which represents a lubricating oil with increased signs of wear (e.g., severely reduced lubricating oil quality) can be respectively fed to a collecting container 5 in which the lubricating oil can collect and gases can be released from the lubricating oil. Those gases which occur in the collecting container 5 can circulate by way of a connecting line 23 to the crankcase 4 of the internal combustion engine 1. That connecting line 23 is arranged in such a way that it connects the crankcase 4 above a liquid level to the collecting container 5 above a liquid level in respect of the lubricating oil (e.g., the liquid levels are symbolically illustrated by horizontal lines).

According to the invention, there is provided a removal device 8, by means of which lubricating oil (which collects in the collecting container 5) can be discharged from the collecting container 5.

In this embodiment, that removal device 8 has a removal line 9, which carries a part of the collected lubricating oil of the collecting container 5 to an old oil tank 12. In that respect, removal of the old lubricating oil from the collecting container 5 can be open-loop or closed-loop controlled by way of the pump 10 of the removal device 8 and/or the open-loop or closed-loop controllable valve 11 of the removal device 8.

As in this embodiment, only a part of the collected lubricating oil in the collecting container 5 is passed to the old oil tank 12 by way of the removal device 8. A return line 13 returns the remaining part of the old lubricating oil to the oil pan 3 of the internal combustion engine 1. It can be provided that a further filter element for lubricating oil or a backflow blocking means (e.g., non-return valve) is provided in that return line 13.

In addition, this embodiment in FIG. 1 has a feed device 14, which feed device 14 can feed fresh lubricating oil by way of a feed line 15 from a fresh oil tank 18 into the oil pan 3 (and thus the oil circuit). The feed device 14 further has a pump 16 of the feed device 14 and an open-loop or closed-loop controllable valve 17 of the feed device 14 to provide for open-loop or closed-loop control of the extent of fed fresh oil volume per unit of time.

There is further provided an open-loop or closed-loop control unit 22, which is connected in signal-conducting relationship by way of signal-conducting connections 21 to the pump 10 of the removal device 8, the open-loop or closed-loop controllable valve 11 of the removal line 9, the pump 16 of the feed device 14 and the open-loop or closed-loop controllable valve 17 of the feed device 14. In that respect, it can be provided, for example, that, by way of the open-loop or closed-loop control unit 22, the removed volume of old oil per unit of time and/or the fed volume of fresh oil per unit of time can be open-loop or closed-loop controlled by way of the pumps 16, 10 and/or the open-loop or closed-loop controllable valves 11, 17. In that respect, it can be provided, for example, that a removed old lubricating oil by way of the removal device 8 is compensated substantially in faithful volume relationship by fresh lubricating oil by way of the feed device 14 by means of the open-loop or closed-loop control unit 22.

It can, however, also be provided that the open-loop or closed-loop control unit 22 is adapted by way of sensors to detect a total oil volume of the internal combustion engine 1 (for example, by way of a filling level by virtue of the liquid level of the lubricating oil in the oil pan) and to provide for open-loop or closed-loop control of the feed device 14 and/or the removal device 8 in such a way that that liquid level (or also the total lubricating oil volume) is kept constant.

LIST OF REFERENCES

1 internal combustion engine
2 oil reservoir
3 oil pan
4 crankcase
5 collecting container
6 turbocharger
7 blow-by filter
8 removal device
9 removal line
10 pump of the removal device
11 open-loop or closed-loop controllable valve of the removal device
12 old oil tank
13 return line
14 feed device
15 feed line
16 pump of the feed device
17 open-loop or closed-loop controllable valve of the feed device
18 fresh oil tank
19 supply line for turbocharger
20 discharge line for blow-by gases
21 signal-conducting connection
22 open-loop or closed-loop control device
23 connecting line

The invention claimed is:

1. An internal combustion engines comprising:

an oil circuit configured to supply at least one component of the internal combustion engine with lubricating oil;

at least one oil reservoir configured to provide the lubricating oil for the oil circuit, wherein the at least one component includes at least one turbocharger and/or a blow-by filter;

at least one collecting container separate from the at least one oil reservoir, wherein the at least one collecting container is configured to collect the lubricating oil in the oil circuit downstream of the at least one component; and at least one oil remover configured to remove at least a first part of the lubricating oil collected in the at least one collecting container from the at least one oil circuit during engine operation of the internal combustion engine, such that the first part of the lubricating oil does not return into the at least one oil reservoir.

2. The internal combustion engine of claim 1, comprising at least one return line configured to return at least a second part of the lubricating oil collected in the at least one collecting chamber into the at least one oil reservoir.

3. The internal combustion engine of claim 1, wherein the at least one oil reservoir comprises an oil pan or an oil sump of the internal combustion engine.

4. The internal combustion engine of claim 1, wherein the at least one component includes the at least one turbocharger.

5. The internal combustion engine of claim 1, wherein the at least one component includes the blow-by filter.

6. The internal combustion engine of claim 1, wherein the at least one oil remover has at least one removal line, at least one pump, at least one open-loop or closed-loop controllable valve, and/or at least one old oil tank.

7. The internal combustion engine of claim 1, comprising at least one oil supply configured to supply additional fresh lubricating oil to the oil circuit via the at least one oil reservoir.

8. The internal combustion engine of claim 7, wherein the at least one oil supply has at least one feed line, at least one pump, at least one open-loop or closed-loop controllable valve, and/or at least one fresh oil tank.

9. The internal combustion engine of claim 7, comprising an open-loop or closed-loop controller connected in signal-conducting relationship to the at least one oil supply and configured to feed a defined volume of lubricating oil to the oil circuit by open-loop or closed-loop control of the at least one oil supply.

10. The internal combustion engine of claim 1, comprising an open-loop or closed-loop controller connected in signal-conducting relationship to the at least one oil remover and configured to remove a defined volume of lubricating oil from the at least one collecting container by open-loop or closed-loop control of the at least one oil remover.

11. The internal combustion engine of claim 7, comprising an open-loop or closed-loop controller configured to maintain constant a total volume of lubricating oil of the oil circuit by open-loop or closed-loop control of the at least one oil supply and/or the at least one oil remover.

12. The internal combustion engine of claim 1, wherein the at least one collecting container and at least one crankcase are connected together above a liquid level so that gases can circulate between the at least one collecting container and the crankcase.

13. A method of operating an internal combustion engine, comprising:

flowing a lubricating oil in an oil circuit to lubricate and/or cool at least one component of the internal combustion engine, wherein the lubricating oil is provided for the oil circuit by at least one oil reservoir, wherein the at least one component includes at least one turbocharger and/or a blow-by filter;

collecting the lubricating oil in the oil circuit downstream of the at least one component in a collecting container separate from the at least one oil reservoir; and removing at least a first part of the lubricating oil collected in the at least one collecting container by an oil remover during engine operation of the internal combustion engine, such that the first part of the lubricating oil does not return into the at least one oil reservoir.

14. The method of claim 13, comprising feeding to the oil circuit a volume of fresh lubricating oil that corresponds to the volume of the first part of the lubricating oil removed from the at least one collecting container.

15. The method of claim 13, wherein the at least one component includes the at least one turbocharger.

16. The method of claim 13, wherein the at least one component includes the blow-by filter.

17. A system, comprising:

a controller configured to control an internal combustion engine to:

flow a lubricating oil in an oil circuit to lubricate and/or cool at least one component of the internal combustion engine, wherein the lubricating oil is provided for the oil circuit by at least one oil reservoir, wherein the at least one component includes at least one turbocharger and/or a blow-by filter;

collect the lubricating oil in the oil circuit downstream of the at least one component in a collecting container separate from the at least one oil reservoir; and remove at least a first part of the lubricating oil collected in the at least one collecting container by an oil remover during engine operation of the internal combustion engine, such that the first part of the lubricating oil does not return into the at least one oil reservoir.

18. The system of claim 17, comprising the at least one component, the internal combustion engine, or a combination thereof.

19. The system of claim 17, wherein the at least one component includes the at least one turbocharger.

20. The system of claim 17, wherein the at least one component includes the blow-by filter.

21. The system of claim 17, wherein the controller is configured to control at least one oil supply to supply a volume of fresh lubricating oil to the oil circuit to compensate for the first part of the lubricating oil removed from the at least one collecting container.

* * * * *